US008660460B2

(12) United States Patent
Itabashi

(10) Patent No.: US 8,660,460 B2
(45) Date of Patent: Feb. 25, 2014

(54) DEVELOPING DEVICE

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 230 days.

(21) Appl. No.: 13/224,542

(22) Filed: Sep. 2, 2011

(65) Prior Publication Data

US 2012/0057897 A1 Mar. 8, 2012

(30) Foreign Application Priority Data

Sep. 6, 2010 (JP) ..... 2010-199320

(51) Int. Cl.
*G03G 15/08* (2006.01)

(52) U.S. Cl.
USPC ..... 399/103

(58) Field of Classification Search
USPC ..... 399/102, 103, 105
See application file for complete search history.

(56) References Cited

U.S. PATENT DOCUMENTS

| | | | | |
|---|---|---|---|---|
| 5,166,472 | A * | 11/1992 | Maeda et al. | 399/281 |
| 5,650,841 | A | 7/1997 | Matsuda et al. | |
| 6,792,227 | B2 | 9/2004 | Itabashi | |
| 7,751,743 | B2 | 7/2010 | Kamimura et al. | |
| 2002/0141777 | A1 | 10/2002 | Kamimura et al. | |
| 2002/0141778 | A1 | 10/2002 | Itabashi | |
| 2006/0245783 | A1 | 11/2006 | Kamimura et al. | |

FOREIGN PATENT DOCUMENTS

| | | | |
|---|---|---|---|
| JP | 60-131571 | | 7/1985 |
| JP | 3-061971 | A | 3/1991 |
| JP | 5-163630 | A | 6/1993 |
| JP | 06-314026 | | 11/1994 |
| JP | 06-317962 | | 11/1994 |
| JP | 11-194612 | | 7/1999 |
| JP | 2001-005287 | | 1/2001 |
| JP | 2001-175135 | A | 6/2001 |
| JP | 2001-356600 | A | 12/2001 |
| JP | 2002-148939 | | 5/2002 |
| JP | 2002-287488 | A | 10/2002 |
| JP | 2003-001773 | A | 1/2003 |
| JP | 2003-005496 | A | 1/2003 |
| JP | 2003-107902 | | 4/2003 |
| JP | 2003-107902 | A | 4/2003 |
| JP | 3104069 | U | 9/2004 |
| JP | 2005-152159 | A | 6/2005 |
| JP | 2006-308801 | A | 11/2006 |

(Continued)

OTHER PUBLICATIONS

Itabashi (JP 2003107902 A; Apr. 2003) JPO Machine Translation.*

(Continued)

*Primary Examiner* — David Gray
*Assistant Examiner* — Erika J Villaluna
(74) *Attorney, Agent, or Firm* — Banner & Witcoff, Ltd.

(57) ABSTRACT

A developing device is provided which includes a developer carrier configured to carry developer and rotate, a developing frame configured to rotatably support the developer carrier, and a seal member disposed between the developing frame and an end portion of the developer carrier in an axial direction of the developer carrier. The seal member includes a base and a mesh textile disposed on top of the base and configured to contact the developer carrier. The mesh textile includes interlacing warp threads and weft threads such that there are spaces between adjacent warp threads and adjacent weft threads.

20 Claims, 7 Drawing Sheets

(56) References Cited

FOREIGN PATENT DOCUMENTS

| | | | |
|---|---|---|---|
| JP | 2007-164021 | A | 6/2007 |
| JP | 2008-156781 | A | 7/2008 |
| JP | 2009-030226 | A | 2/2009 |
| WO | 2011-138822 | A1 | 11/2011 |

OTHER PUBLICATIONS

JP Office Action dtd Sep. 18, 2012, JP Appln. 2010-199320, partial English tranlsation.
Decision to Grant mailed Dec. 11, 2012, JP App 2010-199320, partial English translation.

* cited by examiner

DEVELOPING DEVICE

CROSS REFERENCE TO RELATED APPLICATION

This application claims priority from Japanese Patent Application No. 2010-199320, filed on Sep. 6, 2010, the entire subject matter and contents of which are incorporated herein by reference.

TECHNICAL FIELD

Aspects of the invention relate to a developing device including a developer carrier and sealing members disposed in positions corresponding to both end portions of the developer carrier.

BACKGROUND

A known developing device includes seal members configured to contact both ends of a peripheral surface of a developer carrier. Specifically, the seal members are made of a urethane sponge and Teflon (trademark) felt affixed to the urethane sponge. The Teflon (trademark) felt contacts both ends of the peripheral surface of the developer carrier.

However, while the developer carrier rotates, a friction heat is generated between the developer carrier and the seal members, and the temperature of the friction heat gradually becomes high. Developer melts when the temperature exceeds the melting point of the developer. After the developer carrier is caused to stop rotating, the melt developer solidifies. The peripheral surface of the developer carrier may be sharpened by the solidified developer.

SUMMARY

Aspects of the invention may provide a developing device including a seal member configured to reduce friction between a developer carrier and the seal member and to minimize a rise in the temperature due to friction heat.

According to an aspect of the disclosure, a developing device may include a developer carrier, a developing frame, and a seal member. The developer carrier is configured to carry developer and rotate. The developing frame is configured to rotatably support the developer carrier. The seal member is disposed between the developing carrier and an end of the developer carrier in an axial direction thereof. The seal member includes a base and a mesh textile disposed on top of the base. The mesh textile is configured to slidingly contact the developer carrier. The mesh textile includes interlacing warp threads and weft threads such that there are spaces between adjacent warp threads and adjacent weft threads.

BRIEF DESCRIPTION OF THE DRAWINGS

Illustrative aspects of the disclosure will be described in detail with reference to the following figures in which like elements are labeled with like numbers and in which.

DETAILED DESCRIPTION

An illustrative embodiment of the invention will be described in detail with reference to the accompanying drawings. A developing device according to illustrative aspects of the disclosure is applied to a laser printer 1.

The general structure of the laser printer 1 will be described with reference to FIG. 1.

For ease of discussion, in the following description, the top or upper side, the bottom or lower side, the left or left side, the right or right side, the front or front side, and the rear or rear side are used to define the various parts when the laser printer 1 is disposed in an orientation in which it is intended to be used. In FIG. 1, the right side is referred to as the front or front side, the left side is referred to as the rear or the rear side, the up side is referred to as the top or upper side, and the down side is referred to as the bottom or lower side.

Figure 1:
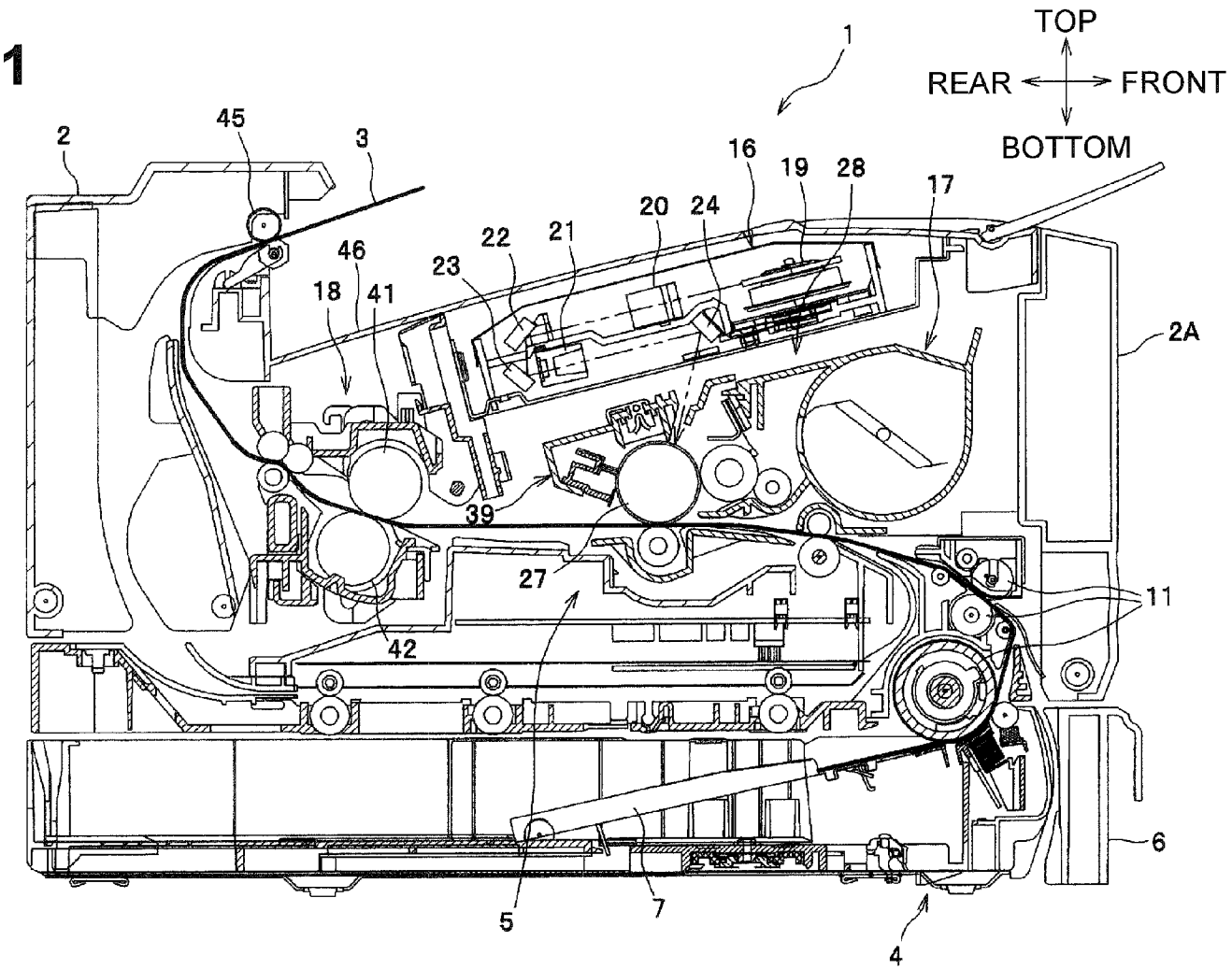
FIG. 1 is a cross sectional view of an illustrative example of a laser printer including a developing cartridge according to an aspect of the disclosure.

As shown in FIG. 1, the laser printer 1 includes, in a body casing 2, a sheet supply unit 4 for supplying a sheet 3, and an image forming unit 5 for forming an image on the sheet 3.

The sheet supply unit 4 includes a sheet supply tray 6, a sheet pressing plate 7, and rollers 11. The sheet supply tray 6 is detachably attachable to a lower portion of the body casing 2. The sheet pressing plate 7 is disposed in the sheet supply tray 6. The rollers 11 are configured to convey a sheet 3. The sheet 3 stored in the sheet supply tray 6 is moved upward by the sheet pressing plate 7 and conveyed to the image forming unit 5 by the rollers 11.

The image forming unit 5 includes a scanner unit 16, a process cartridge 17, and a fixing unit 18.

The scanner unit 16 is disposed in an upper portion in the body casing 2. The scanner unit 16 includes a laser light source (not shown), a polygon mirror 19, lenses 20 and 21, and reflecting mirrors 22, 23, and 24. In the scanner unit 16, as shown in a chain double-dashed line, a laser beam emitted from the laser light source, based on print data, is deflected by the polygon mirror 19, passes through the lens 20, is folded by the reflecting mirrors 22 and 23, passes through the lens 21, is folded by the reflecting mirror 24, and then directed to a surface of a photosensitive drum 27.

A process cartridge 17 is detachably attachable to the body casing 2 when a front cover 2A of the body casing 2 is open. The process cartridge 17 mainly includes a developing cartridge 28, as an example of a developing device, and a drum unit 39.

The developing cartridge 28 is detachably attachable to the body casing 2 together with the drum unit 39. The developing cartridge 28 may be configured to be detachably attachable to the drum unit 39 fixed to the body casing 2.

Figure 2:
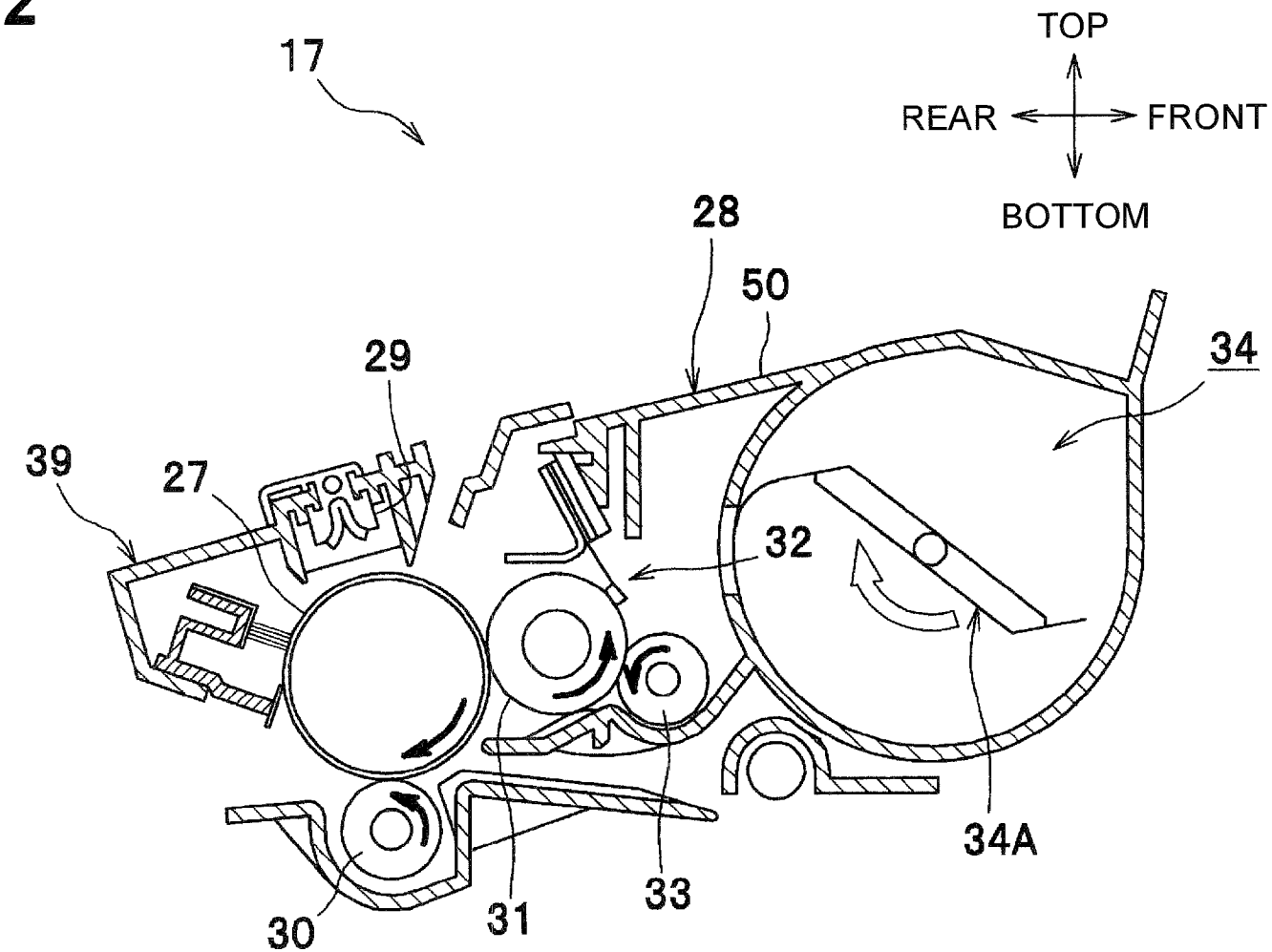
FIG. 2 is a cross sectional view of the developing cartridge.

As shown in FIG. 2, the developing cartridge 28 includes, in a developing frame 50, a developing roller 31 as an example of a developer carrier, a layer-thickness regulating blade 32, a supply roller 33, and a toner storing chamber 34.

In the developing cartridge 28, an agitator 34A agitates toner, as an example of developer, stored in the toner storing chamber 34, and then the supply roller 33 supplies the agitated toner to the developing roller 31. At this time, the toner is positively charged by friction between the supply roller 33 and the developing roller 31. The toner supplied to the developing roller 31 goes between the layer-thickness regulating blade 32 and the developing roller 31, is further charged by friction therebetween, and carried on the developing roller 31 as a thin layer having uniform thickness.

The drum unit 39 mainly includes a photosensitive drum 27, a scorotron charger 29, and a transfer roller 30. In the drum unit 39, the surface of the photosensitive drum 27 is uniformly and positively charged by the charger 29, and then exposed to a laser beam from the scanner unit 16, which is scanned at high speed. The potential becomes low in an area exposed to the laser beam, in which an electrostatic latent image is formed based on image data.

By rotation of the developing roller 31, the positively charged toner carried on the surface of the developing roller is supplied to the electronic latent image formed on the surface of the photosensitive drum 27, and a toner image is formed on the surface of the photosensitive drum 27. Then, the toner image is transferred to a sheet 3 being conveyed between the photosensitive drum 27 and the transfer roller 30.

As shown in FIG. 1, the fixing unit 18 includes a heat roller 41 and a pressure roller 42 applying pressure to the heat roller 41. In the fixing unit 18, the toner image transferred to the sheet 3 is fixed onto the sheet 3 by heat when the sheet 3 passes between the heat roller 41 and the pressure roller 42. The sheet 3 having the toner image fixed by heat, is conveyed to the ejection tray 46 by an ejection roller 45 disposed downstream from the fixing unit 18.

The structure of the developing cartridge 28 will be described in detail.

Figure 3:
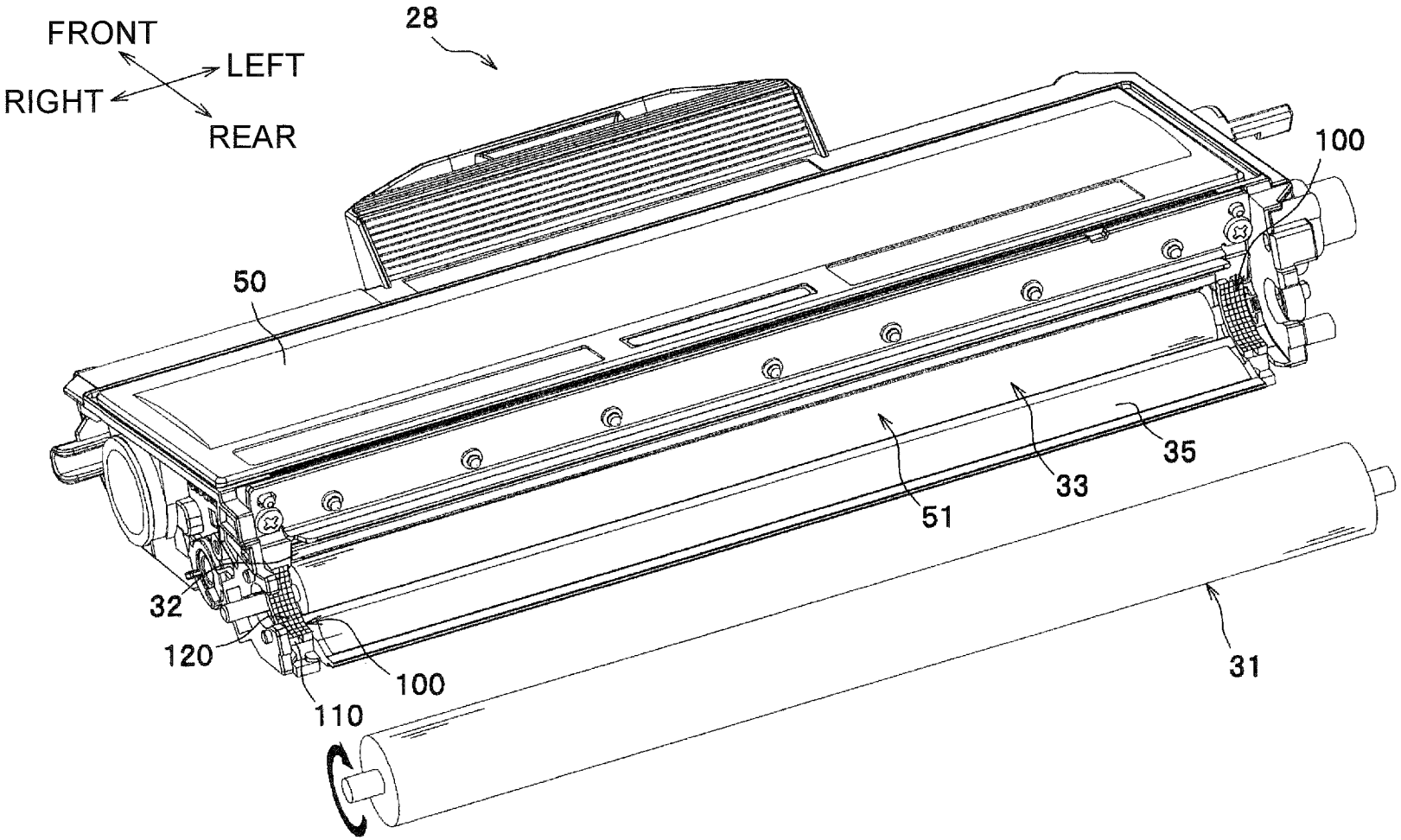
FIG. 3 is a perspective view of the developing cartridge from which side covers and a developing roller are removed.

As shown in FIG. 3, the developing frame 50 has, on the rear side, an opening 51 in which the developing roller 31 is fitted so as to close the opening 51. A film 35 is disposed at a lower end of the opening 51 and seal members 100 are disposed on both sides of the opening 51. The layer-thickness regulating blade 32 is disposed on an upper end of the opening 51 so as to extend in the right and left direction.

Figure 4:
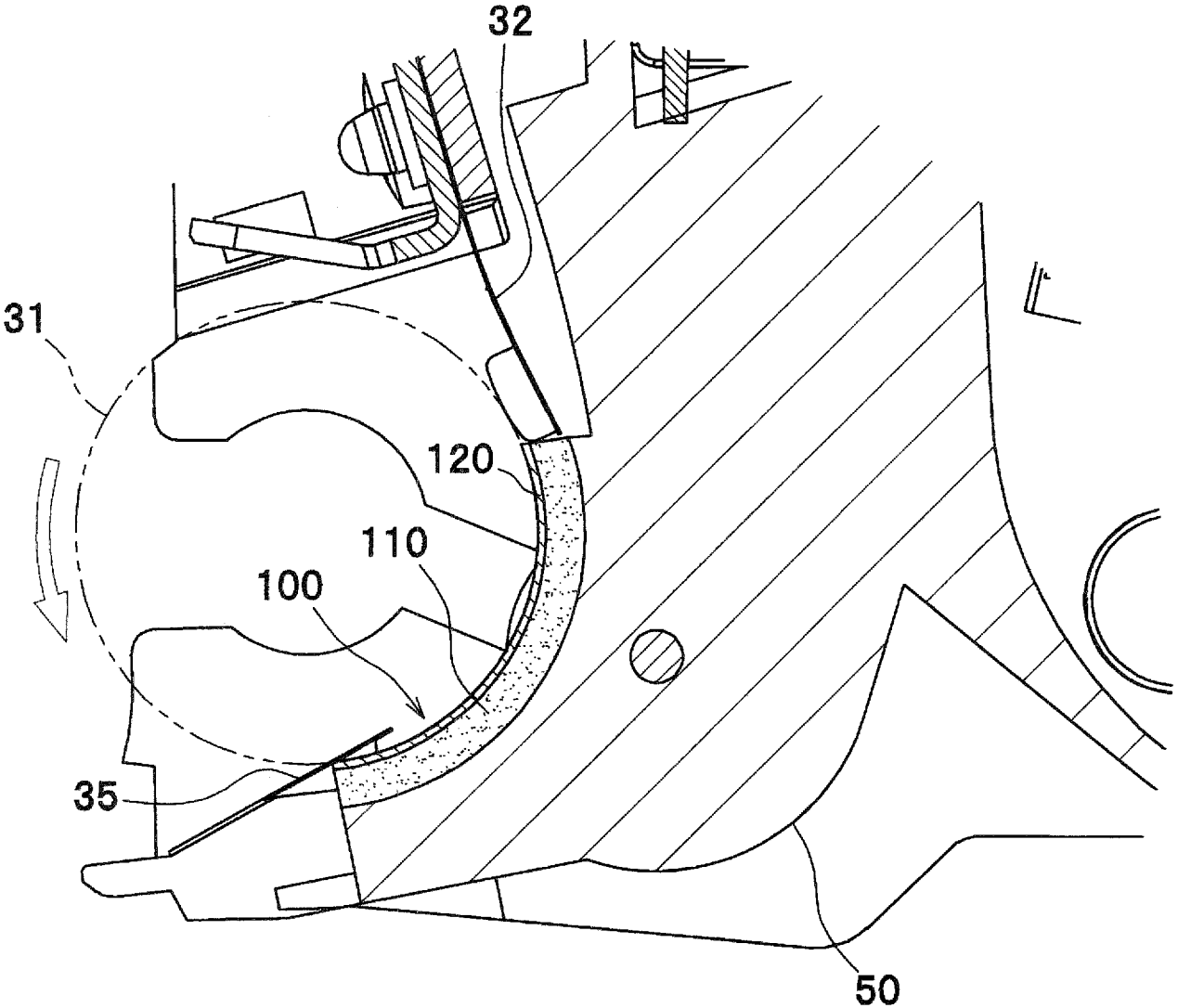
FIG. 4 is a cross sectional view illustrating an illustrative seal member on the left side of the developing cartridge.

As shown in FIG. 4, the seal member 100 is disposed along the shape of the peripheral surface of the developing roller 31 and contacts the developing roller 31. The film 35 contacts the lower portion of the developing roller 31, and the layer-thickness regulating blade 32 contacts the upper portion of the developing roller 31. To reduce potential for toner in the developing frame 50 from leaking from the circumference of the developing roller 31, the developing roller 31 is brought into intimate contact with the layer-thickness regulating blade 32, the film 35, and the seal members 100 on the upper, lower, right and left sides.

Figure 5A:
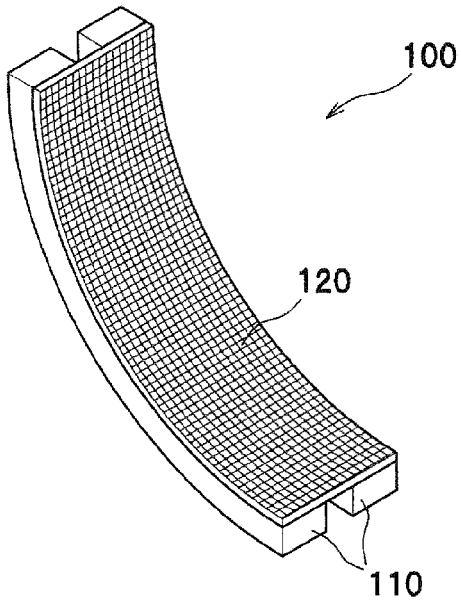
FIG. 5A is a perspective view of the seal member.

As shown in FIG. 5A, the seal member 100 includes a pair of bases 110 and a textile 120. The textile 120 is attached to upper surfaces of the bases 110 with an adhesive such that the bases 110 are coupled.

The bases 110 are each made of polyurethane foam, e.g. PORON (registered) foam, shaped into substantially a rectangle, and have high elasticity such that the textile 120 contacts the developing roller 31. The bases 110 are spaced a predetermined distance apart from each other under the textile 120 to form a groove for releasing toner entering the textile 120. The seal members 100 are disposed in positions of the developing frame 50 corresponding to both ends of the developing roller 31 (see FIG. 3) such that the bases 110 are spaced apart in an axial direction of the developing roller 31 and extend in a direction perpendicular to the axial direction of the developing roller 31 or in a circumferential direction of the developing roller 31. Thus, the groove formed between the bases 110 under the textile 120 extends in the circumferential direction of the developing roller 31.

Figure 5B:
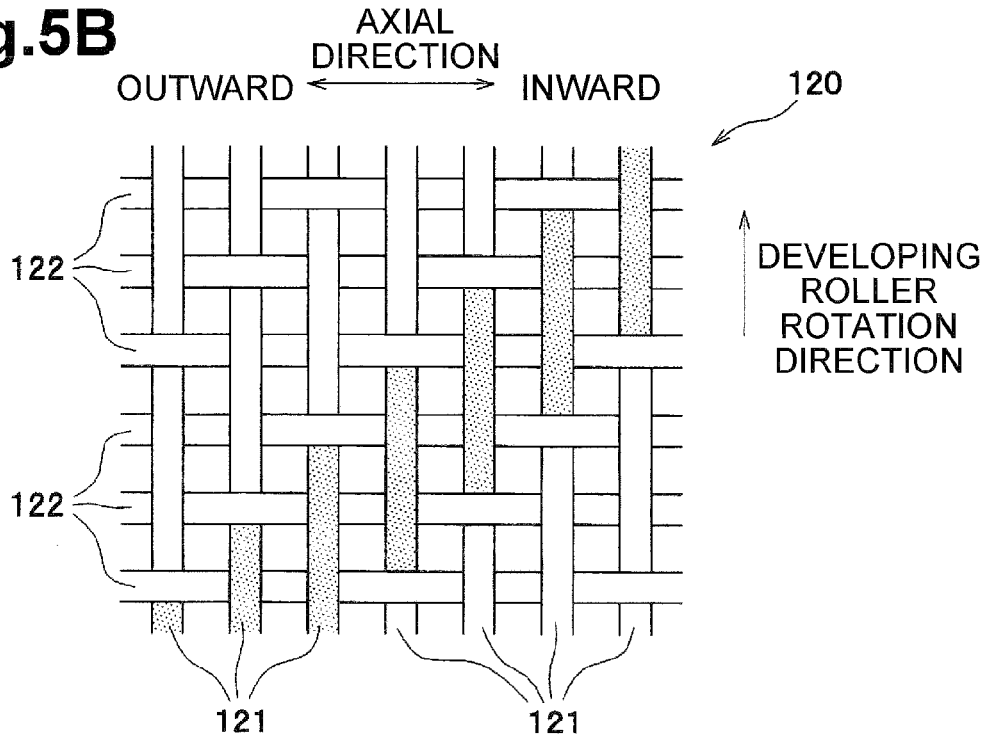
FIG. 5B is an enlarged view of a textile surface.

As shown in FIG. 5B, the textile 120 is a mesh textile in sheet form, and includes warp threads 121 and weft threads 122 loosely interfacing with each other such as to have spaces between adjacent warp threads and adjacent weft threads 122. The weave of interlacing the warp threads 121 and the weft threads 122 is not limited to plain weave or twill weave. In this embodiment, the textile 120 is a cloth made with twill weave in which each warp thread 121 passes over a plurality of, e.g., two, adjacent weft threads 122 and then under one weft thread 122. In the textile 120 woven in such a manner, warp threads 121 protrude toward the developing roller 31 at portions in which the warp threads 121 pass over weft threads 122. The protruding warp threads 121 (shaded in FIG. 5B) are arranged in a diagonal line such that the protruding warp threads 121 are located inwardly, relative to the axial direction of the developing roller 31, in a direction from an upstream side of the rotation direction of the developing roller 31 toward a downstream side thereof. The diagonal line has an angle of less than 45 degrees relative to the rotation direction of the developing roller 31.

The warp threads 121 and the weft threads 122 are fixed, e.g., by melting, at crossing portions in such a degree that the spaces between the threads are not displaced or the textile 120 does not fray at edges. It is desirable that a surface of the textile 120, on which the developing roller 31 slides, be coated with lubricant to reduce friction between the developing roller 31 and the textile 120.

According to the embodiment, the seal member 100 includes the bases 110 and the textile 120 of mesh on which the peripheral surface of the developing roller 31 slidingly contacts. As the seal member 100 includes the textile 120 of mesh, a contact area between the peripheral surface of the developing roller 31 and the textile 120 is small and thus friction therebetween is reduced. In addition, as the textile 120 is breathable, even when a friction heat is generated between the developing roller 31 and the textile 120, a rise in temperature can be reduced.

The bases 110 are spaced apart from each other in the seal member 100. Even when toner comes into the seal member 100, it may enter the groove between the bases 110, thus reducing the potential for toner leakage outside.

The textile 120 is made with twill weave such that protruding threads are arranged in the diagonal line having an angle of less than 45 degrees relative to the rotation direction of the developing roller 31. Through the usage of the textile 120 structured above, even when toner enters the textile 120, it can be returned toward the toner storing portion 34.

The illustrative embodiment shows, but the disclosure is not limited to, the textile 120 having a single mesh layer. The textile 120 may have a plurality of mesh layers. With the textile 120 having mesh layers, more spaces may be formed on top of the bases 110, the seal member 100 may be more breathable, and a rise in temperature can be reduced.

The illustrative embodiment shows, but the disclosure is not limited to, that one seal member 110 includes a pair of bases 110 spaced apart from each other. Instead, one seal member 110 may include one base having a recessed portion, which is located in a central portion in the axial direction of the developing roller 31 and extends in a circumferential direction of the developing roller 31.

The illustrative embodiment shows, but the disclosure is not limited to, that the textile 120 is woven by passing each warp thread 121 over two adjacent weft threads 122 and under one weft thread 122. The textile 120 may be woven by passing each warp thread 121 over three adjacent weft threads 122 and under one weft thread 122.

The illustrative embodiment shows, but the disclosure is not limited to, the textile 120 with twill weave. The textile 120 may be woven with plain weave in which the warp threads 121 and the weft threads 122 alternately cross over and under each other.

The illustrative embodiment shows, but the disclosure is not limited to, that the textile 120 is woven by interlacing warp threads 121 and weft threads 122 which are identical in diameter. A warp thread may be made of threads having different sizes of diameters.

Figure 6:
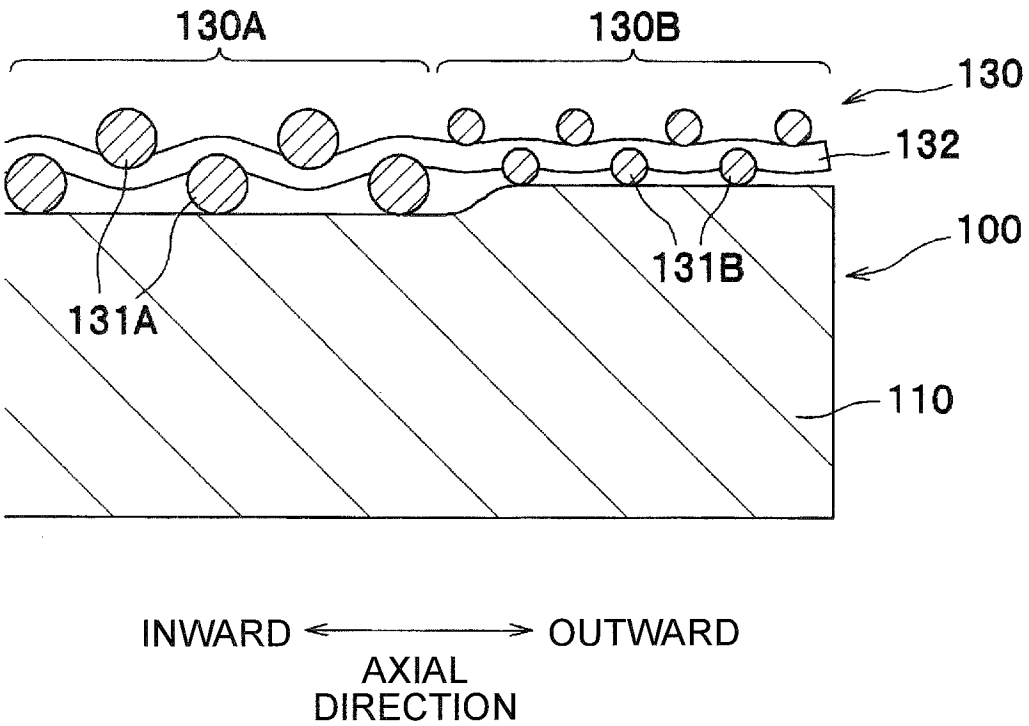
FIG. 6 is a cross sectional view of a seal member according to an aspect of the disclosure.

For example, as shown in FIG. 6, a textile 130 has a first area 130A woven using warp threads 131A and a second area 130B woven using warp threads 131B, smaller in diameter size than the warp threads 131A. The first area 130A is disposed inward in the axial direction of the developing roller 31, and the second area 130B is disposed outward in the axial direction of the developing roller 31.

By changing warp thread diameter size between inner portion and outer portion of the textile 130, the first area 130A facilitates returning toner, which enters the textile 130, inward (toward the toner storing chamber 34) and the second area 130B can reduce toner having not returned inward in the first area 130A from leaking outward.

The illustrative embodiment shows, but the disclosure is not limited to, application of the aspects described herein to the laser printer 1. For example, one or more aspects described herein may be applied to other image forming apparatuses, e.g., a copier and a multifunction apparatus.

The following will describe experiments conducted for determining the temperature of the peripheral surface of the developing roller slidingly contacting the seal member.

1. Method of Measuring the Temperature of the Peripheral Surface of the Developing Roller The temperature of an area of the peripheral surface of the developing roller which contacts the seal member was measured every specified time under the following conditions:

(1) Developing roller rotation speed: 20 ppm or equivalent (2) Thermometer: Laser thermometer (EMISSION THERMOMETER 530-03, manufactured by YOKOGAWA)

2. Conditions of Experiments and a Comparative Example

Conditions of each experiment and a comparative example were made as follows:

EXAMPLE 1

As a seal member, a textile having the following features was used:

Material: Polyester

Thread diameter: 33 μm

Space size between threads: 10 μm

EXAMPLE 2

As a seal member, a textile having the following features was used:

Material: Polyester

Thread diameter: 35 μm

Space size between threads: 20 μm

EXAMPLE 3

As a seal member, a textile having the following features was used:

Material: Nylon

Thread diameter: 55 μm

Space size between threads: 72 μm

COMPARATIVE EXAMPLE 1

To compare with examples 1 to 3, a seal member made of Teflon (registered trademark) felt was used.

As a reference temperature of the developing roller without seal member, the temperature of the central portion of the peripheral surface of the developing roller in the axial direction was measured.

3. Results

Figure 7:
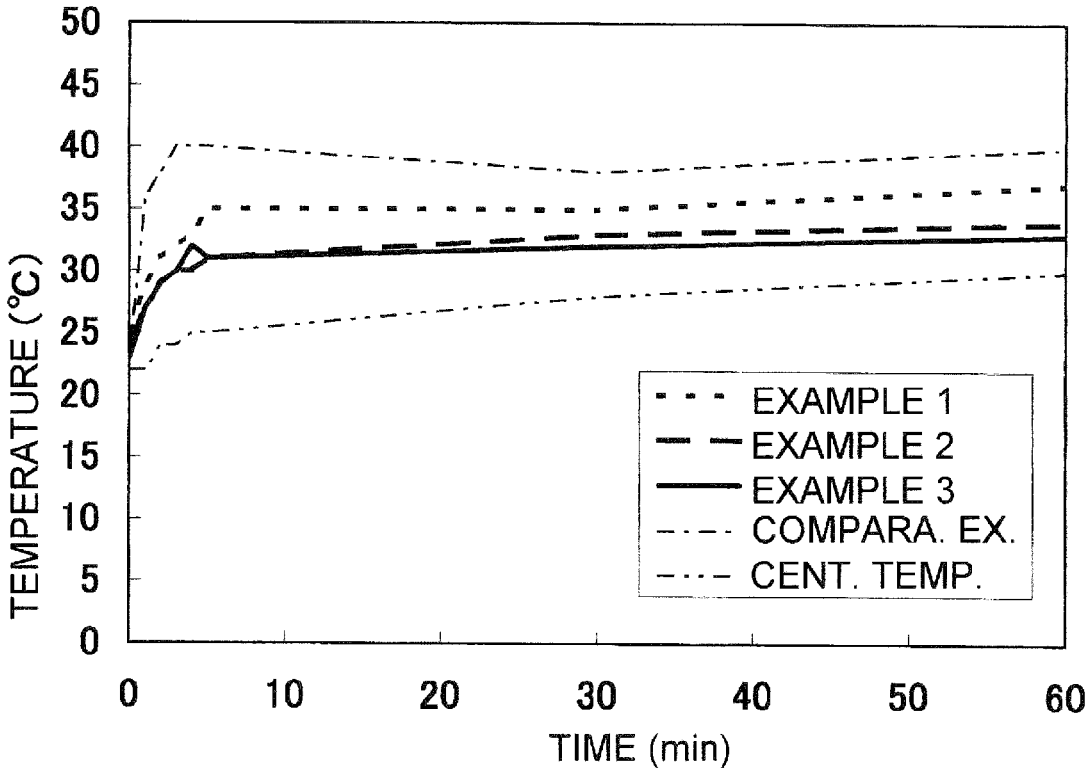
FIG. 7 is a graph illustrating a relationship between a rotation time of the developing roller and a rise in temperature at a peripheral surface of the developing roller slidingly contacting the seal member.

FIG. 7 illustrates temperature measuring results for examples 1 to 3 and comparative example 1.

In examples 1 to 3, the rise in the temperature was great as compared with the temperature of the central portion of the peripheral surface of the developing roller. However, it was found that the rise in the temperature was small in each experiment as compared with the comparative example 1 using the felt seal member.

Among examples 1 to 3, example 1 having the smallest space size shows the greatest rise in temperature, and example 3 having the greatest space size shows the smallest rise in temperature.

In examples 1 to 3, it was found that there was no toner leakage between the developing roller and the developing frame in a place where each seal member was disposed.

Although an illustrative embodiment and examples of modifications of the present invention have been described in detail herein, the scope of the invention is not limited thereto. It will be appreciated by those skilled in the art that various modifications may be made without departing from the scope of the invention. Accordingly, the embodiment and examples of modifications disclosed herein are merely illustrative. It is to be understood that the scope of the invention is not to be so limited thereby, but is to be determined by the claims which follow.

What is claimed is:

1. A developing device comprising:

a developer carrier configured to carry developer and rotate;

a developing frame configured to rotatably support the developer carrier; and a seal member disposed between the developing frame and an end portion of the developer carrier in an axial direction of the developer carrier, the seal member including:

a base; and a mesh textile disposed on top of the base and configured to contact the developer carrier, the mesh textile including interlacing warp threads and weft threads such that there are spaces between adjacent warp threads and adjacent weft threads, wherein the base has a groove under the mesh textile.

2. The developing device according to claim 1, wherein the warp threads and the weft threads are fixed at crossing portions in which the warp threads and the weft threads cross each other.

3. The developing device according to claim 1, wherein the mesh textile has a single layer.

4. The developing device according to claim 1, wherein the mesh textile includes a first area and a second area woven using warp threads having a smaller diameter than that of warp threads in the first area, and wherein the mesh textile is disposed such that the first area is located inward in an axial direction of the developer carrier and the second area is located outward more than the first area in the axial direction of the developer carrier.

5. The developing device according to claim 1, wherein the groove extends in a circumferential direction of the developer carrier.

6. The developing device according to claim 1, wherein the mesh textile includes a first portion contacting the base, a second portion contacting the base, and a third portion disposed between the first portion and the second portion and facing the groove.

7. The developing device according to claim 1, wherein the mesh textile is applied with a lubricant on a surface that is to contact the developer carrier.

8. The developing device according to claim 1, wherein the mesh textile includes protruding threads protruding from the mesh textile toward the developer carrier, and wherein the protruding threads are arranged in a diagonal line such that the protruding threads are located inwardly, relative to the axial direction of the developer carrier, in a direction from an upstream side of a rotation direction of the developer carrier toward a downstream side thereof.

9. The developing device according to claim 8, wherein the diagonal line has an angle of less than 45 degrees relative to the rotation direction of the developer carrier.

10. The developing device according claim 8, wherein the protruding threads are the warp threads each passing over a plurality of adjacent weft threads in the mesh textile.

11. The developing device according to claim 1, wherein the base is made of polyurethane foam.

12. The developing device according to claim 1, wherein the mesh textile is made of nylon.

13. The developing device according to claim 1, wherein the mesh textile is made of polyester.

14. A developing device comprising:

a developer carrier configured to carry developer and rotate;

a developing frame configured to rotatably support the developer carrier; and a seal member disposed between the developing frame and an end portion of the developer carrier in an axial direction of the developer carrier, the seal member including:

a base; and a mesh disposed on top of the base and configured to contact the developer carrier, wherein the base has a groove under the mesh, and wherein the mesh includes a first portion contacting the base, a second portion contacting the base, and a third portion disposed between the first portion and the second portion and facing the groove.

15. A developing device comprising:

a developer carrier configured to carry developer and rotate;

a developing frame configured to rotatably support the developer carrier; and a seal member disposed between the developing frame and an end portion of the developer carrier in an axial direction of the developer carrier, the seal member including:

a base; and a mesh textile disposed on top of the base and configured to contact the developer carrier, the mesh textile including interlacing warp threads and weft threads such that there are spaces between adjacent warp threads and adjacent weft threads, wherein the mesh textile includes a first area and a second area woven using warp threads having a smaller diameter than that of warp threads in the first area, and wherein the mesh textile is disposed such that the first area is located inward in an axial direction of the developer carrier and the second area is located outward more than the first area in the axial direction of the developer carrier.

16. The developing device according to claim 15, wherein the warp threads and the weft threads are fixed at crossing portions in which the warp threads and the weft threads cross each other.

17. The developing device according to claim 15, wherein the mesh textile has a single layer.

18. The developing device according to claim 15, wherein the mesh textile is applied with a lubricant on a surface that is to contact the developer carrier.

19. The developing device according to claim 15, wherein the mesh textile includes protruding threads protruding from the mesh textile toward the developer carrier, and wherein the protruding threads are arranged in a diagonal line such that the protruding threads are located inwardly, relative to the axial direction of the developer carrier, in a direction from an upstream side of a rotation direction of the developer carrier toward a downstream side thereof.

20. The developing device according claim 19, wherein the protruding threads are the warp threads each passing over a plurality of adjacent weft threads in the mesh textile.

* * * * *